United States Patent [19]

Ciniglio et al.

[11] 4,056,238

[45] Nov. 1, 1977

[54] APPARATUS AND A METHOD OF WINDING FILAMENTARY MATERIAL

[75] Inventors: Alexander J. Ciniglio, Brentwood; Richard M. Hadfield, London, both of England

[73] Assignee: Rotawinder Limited, Ilford, England

[21] Appl. No.: 643,799

[22] Filed: Dec. 23, 1975

[30] Foreign Application Priority Data

Jan. 30, 1975 United Kingdom ..... 4186/75
July 24, 1975 United Kingdom ..... 31074/75

[51] Int. Cl.[2] ..... B65H 54/02

[52] U.S. Cl. ..... 242/25 R; 57/67; 140/92.1; 242/7.14; 242/47

[58] Field of Search ..... 242/25 R, 47, 7.11, 242/7.13, 82, 2, 7.09, 7.14; 57/67, 68, 71, 99, 10; 140/92.1

[56] References Cited

U.S. PATENT DOCUMENTS

| | | | |
|---|---|---|---|
| 609,620 | 8/1898 | Leist | 242/7.14 |
| 633,957 | 9/1899 | Graf | 57/67 X |
| 1,618,519 | 2/1927 | DeRoysancour | 57/67 |
| 3,174,270 | 3/1965 | Blaschke | 57/67 |
| 3,383,851 | 5/1968 | Hickman | 242/47 X |
| 3,624,898 | 12/1971 | Droll | 140/92.1 X |
| 3,628,575 | 12/1971 | Hill | 242/7.09 X |
| 3,658,269 | 4/1972 | Giuseppe | 242/7.09 |
| 3,811,630 | 5/1974 | Muskulus et al. | 242/7.11 |

*Primary Examiner*—Stanley N. Gilreath
*Attorney, Agent, or Firm*—Brady, O'Boyle & Gates

[57] ABSTRACT

A fly winder capable of high speed operation comprises a hollow rotatable axially stationary flier and a rotationally stationary bobbin support concentric with the flier and axially reciprocable towards and away from an open end of the flier, the hollow interior of the flier being conical (that is to say stepless) and forming a wire guide, the greater diameter end of the hollow interior being disposed adjacent to the bobbin support and being of diameter such that a bobbin mounted on the support can be received therein, an eyelet being mounted on the flier at the greater diameter end of the cone and through which the wire is constrained to pass before being wound on the bobbin. Thus the wire enters the cone substantially on the axis of rotation of the flier and is free to assume its own position in the wire guide, which in practice tends to be a helix.

9 Claims, 5 Drawing Figures

APPARATUS AND A METHOD OF WINDING FILAMENTARY MATERIAL

The invention relates to the winding of filamentary material, such as wire, on a bobbin.

A technique generally known as "fly winding" is currently available for wrapping wire around a stationary bobbin and the technique has certain inherent advantages over-wire wrapping systems in which the bobbin is rotated. Thus for example where a bobbin is rotated at high speed centrifugal force tends to loosen the wire so that correct winding is rendered difficult or impossible. The device normally used for fly winding comprises a hollow shaft to which a cranked arm carrying wire guides is attached. A bobbin is placed inside the swing of the cranked arm and on the same axis as the shaft and wire is threaded through the shaft, around the wire guides of the cranked arm and is attached to the bobbin or to some point adjacent to it. Rotation of the shaft and the cranked arm while the bobbin is axially reciprocated wraps the wire around the bobbin and draws more wire over the guides and through the hollow shaft. This method involves a number of more or less sharp changes of direction for the wire which causes a drag effect similar to that produced when a rope is wrapped around a bollard for arresting the movement of a ship. This form of drag is called "bollard effect". The formula for "bollard" effect (the factor by which tension is multiplied as a result of directional change at a wire guide or bend in a guide tube) is $e^{\mu\theta}$. where $\mu$ is the coefficient of friction and $\theta$ the change of direction in radians.

A typical cranked arm design will have four guides, one at each end of the hollow shaft and two on the cranked arm. The wire will change direction through 45° from the exit of the hollow shaft to the entry of the first guide, a further 45° change in direction then being necessary to bring it parallel to the rotational axis of the shaft and a final 90° change in direction being required from the last wire guide onto the bobbin being wound, making a total of 180° of "bollard" effect. This however is only true in static or slow winding conditions.

When winding at high speed and, especially onto rectangular bobbins, "flap" develops due to small imperfections at the wire supply reel and due to inherent speed changes of the wire when winding rectangular bobbins. This flap produces additional and fluctuating "bollard effect" at the entry to the wire guides in the system. This fluctuating bollard effect is particularly disadvantageous because it may make it impossible to achieve a satisfactory average level of tension without producing peaks of tension in excess of the breaking strain of the wire.

Sometimes a tube is used as a wire guide or "flier" instead of a series of guides. This system eliminates flap at the entry to the guides but it has the disadvantage that the lubricants used by wire manufacturers accumulate on the walls of the tube and cause adhesion of the wire after a period of running. This adhesion aggravates the "bollard" effect which is inherent in the system.

It is an object of the present invention to provide a fly winder capable of high speed operation.

According to the invention there is provided a fly winder comprising a hollow rotatable axially stationary flier and a rotationally stationary bobbin support concentric with the flier and axially reciprocable towards and away from an open end of the flier, the hollow interior of the flier being smooth, of gradually increasing diameter along its length and being symmetrical about the axis of rotation thereof and forming a wire guide, the greater diameter end of the hollow interior being disposed adjacent to the bobbin support and being of diameter such that a bobbin mounted on the support can be received therein, a guide member (preferably an eyelet) being disposed at or adjacent to the greater diameter end and through which the wire is constrained to pass before being wound on the bobbin. Preferably the hollow interior of the flier is conical or at least substantially so, and is arranged so that the wire enters the hollow interior substantially on the axis of rotation of the flier. In such an arrangement the wire on entering the flier is free to assume its own position in the wire guide, and it has been found in practice that the wire tends to assume a helical formation before passing through the guide member, because in passing from the apex towards the rim of the cone, the rotational speed of the wire increases rapidly. Due to inertia the wire lags behind the rotating surface until the tension of the wire balances the lag forces. This helix of wire acts as a reservoir which absorbs the fluctuations in feed rate demanded when winding rectangular bobbins and damps out small tension increases which arise due to imperfections on the supply reel of wire.

Advantageously the cone angle (the angle between the cone surface and its axis) of the wire guide is less than 45° and preferably substantially less e.g. is 10° so as to minimise directional changes in the wire. In this manner the total directional change of the wire can be reduced to 110°. Also fluctuating bollard effects are reduced partly because there are fewer guides but also because the wire clings to the wall of the conical tunnel thus stabilising the wire path.

The flier is itself preferably substantially conical in shape and is symmetrical about its axis of rotation to facilitate high speed operation by being of low mass and inherently good balance.

Advantageously, the invention provides means for rotating the flier and means for reciprocating the bobbin support which preferably have a common drive means, whereby the speed of rotation of the guide device is proportional to the speed of reciprocation of the support.

A stepless conical wire guide affords the advantages of high strength combined with low weight which is important since the flier must be accelerated and decelerated rapidly, and safely, in that it constitutes a protective shield should anything be thrown off the bobbin during operation.

When winding rectangular bobbins - particularly slab like bobbins with provision for containing several reed relays side by side, the linear speed change of the wire as the guide alternates between traversing either the long or short side of the bobbin is very large perhaps from zero to 30 mph and back to zero twice in every revolution i.e. typically every 1/1,000 second. This can cause the wire to overshoot the guide member during periods of deceleration and result in a wavy pattern in the winding which may cause wire to loop over the end cheeks of the bobbin in places.

The present invention seeks to prevent such overshooting.

In accordance with the present invention, a fly winder as defined above has a keeper positioned to restrain movement axially of the flier of the portion of the wire passing over the guide member.

In order to enable the invention to be more readily understood embodiments thereof will now be described by way of example with reference to the accompanying drawings, in which.

Figure 1:
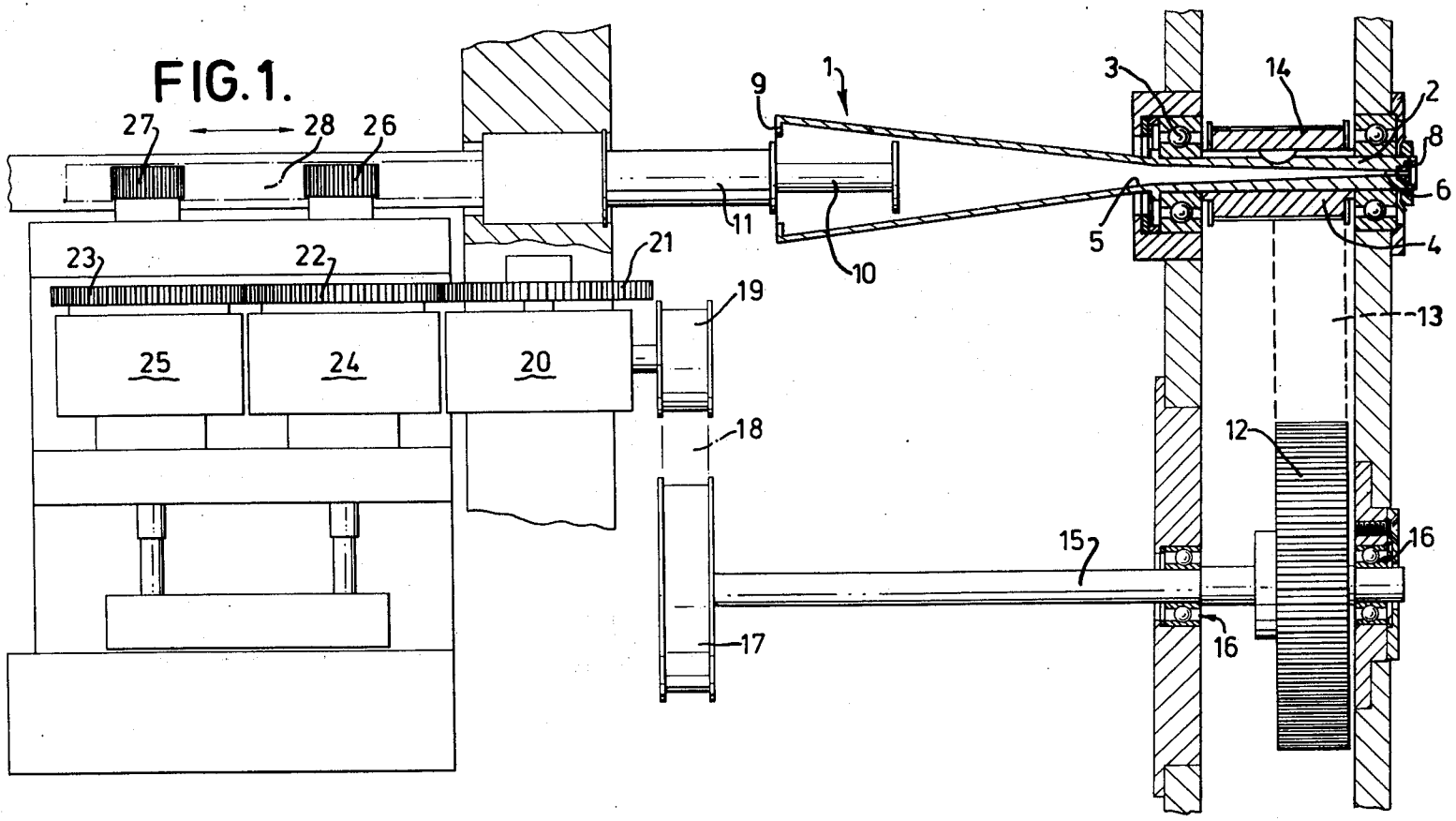
FIG. 1 is a partly-sectional view of a first embodiment of an apparatus for fly-winding an electrical coil.
Figure 2:
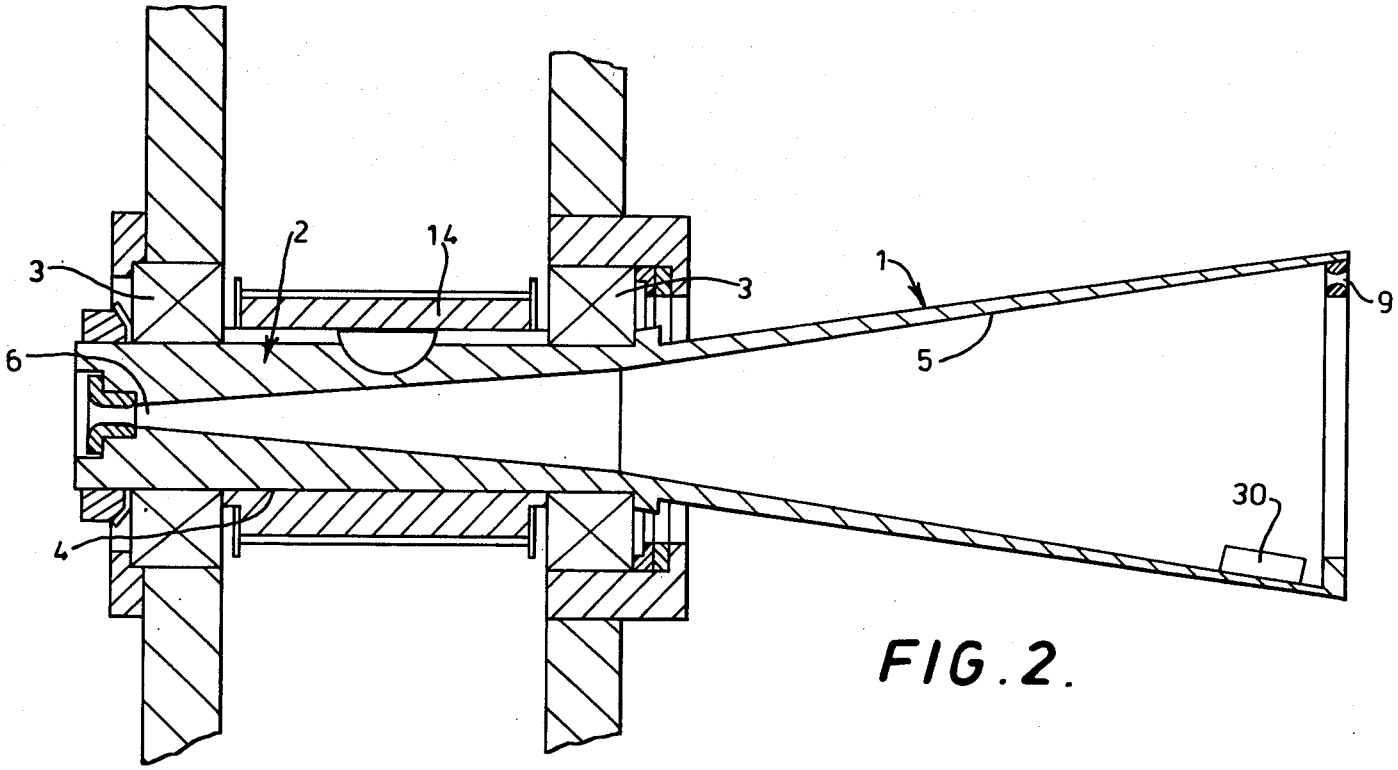
FIG. 2 is enlarged cross-sectional view of part of the apparatus of FIG. 1.

In the drawings an apparatus for winding an electrical coil comprises a hollow flier 1, one end 2 of which is supported by a pair of ball bearings generally indicated as 3 so that the flier is rotatable about its axis. The bearings 3 are of conventional construction and so are not described in detail. The flier 1 is generally frusto-conical in shape and is formed at its said one end 2 with a generally cylindrical section 4 to facilitate the mounting thereof in the bearings 3. Internally the flier is formed with a smooth, stepless substantially conical recess 5 extending through the flier from end to end so that the flier is a hollow thin-walled tubular member. The conical recess 5 defines a wire guide and is concentric with the axis of rotation of the flier, and the small end 6 of the recess emerges from the end of the flier which is supported by the bearings 3. A ceramic guide member or eyelet 8 is mounted to define the entrance to the small end of the conical recess, and a guide member 9 is disposed in the conical recess at its wide end, through which guide member the wire is constrained to pass before being wound on to a bobbin. The member 9 is also a ceramic eyelet having belled-out entry and exit sections since, as described more fully below, the wire follows a helical path through the flier, and since in exiting from the eyelet the wire is bent through approximately 100°. A counter-balancing weight 30 is provided opposite the guide member 9.

Figure 3:
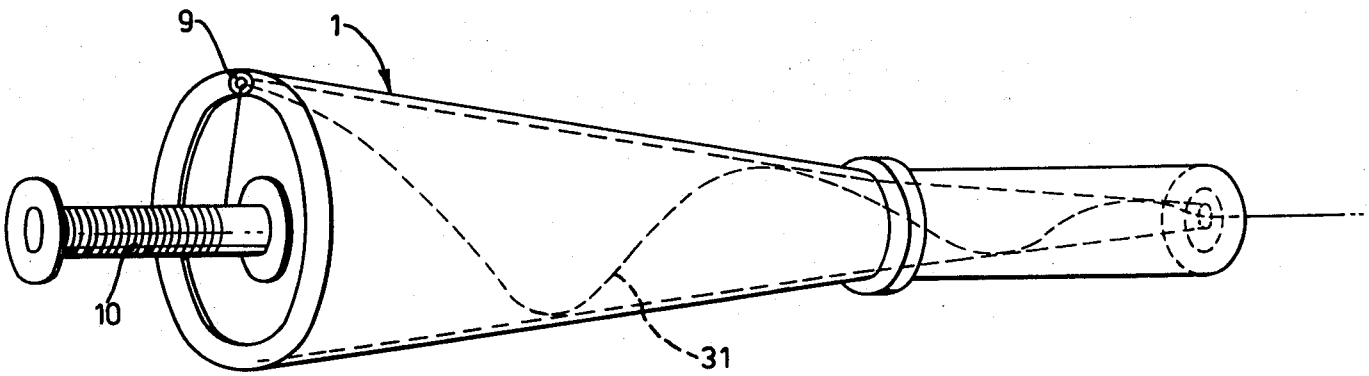
FIG. 3 is a ghost perspective view of a flier in accordance with FIGS. 1 and 2 in use.

The bobbin 10 is mounted on the end of a support shaft 11 which is arranged to reciprocate such that the bobbin moves between a position wholly within the flier (as shown) and a position in which only the free end of the bobbin is within the shaft. In use, wire passes through the insert 8, the conical recess 5, and the guide member 9 from whence it is wound onto the bobbin 10. During passage of the wire 31 through the conical wire guide of the flier, it assumes a helical path as indicated in FIG. 3 due to the fact that in moving along the flier the rotational speed of the wire increases progressively as the diameter of the guide surface increases. Thus due to inertia the wire tends to lag behind the rotating flier and so assumes a helical configuration in the guide.

The means for rotating the flier and the means for reciprocating the shaft 11 will now be described.

A transmission shaft 15 supported in bearings 16 is arranged to be driven by an electric motor (not shown). A toothed wheel 12 is fixedly secured on the shaft 15 between the bearings 16 and transmits the drive of the shaft 15 to the flier by means of a toothed belt 13 (shown in dash-dot lines) and a toothed drum 14 fixedly mounted on the flier end 2. The drum is of sufficient length to accommodate two drive belts if desired. At the end of the shaft 15 remote from the flywheel is a wheel 17 connected by a belt 18 to a wheel 19 on the input shaft of a gearbox 20. Conveniently a worm-reduction gear is employed, e.g. having a reduction ratio of 40:1. A cam device may be incorporated for changing the reduction ratio.

The output shaft of the gear box 20 drives a first toothed wheel 21, which meshes with a second toothed wheel 22, which in turn meshes with a third toothed wheel 23. The second and third toothed wheels 22 and 23 are associated with right-hand and left-hand clutches 24 and 25 respectively. The right-hand clutch is arranged to drive a pinion 26 and the left-hand clutch a pinion 27 both of which engage a rack 28 mounted on the shaft 11. It will be appreciated that when the right-hand clutch is engaged, the rack 28, and with it the shaft 11, are moved in one axial direction, and when the left-hand clutch is engaged the rack 28 and shaft 11 are moved in the opposite axial direction. In each case, the pinion 26 or 27 which is not engaged freewheels.

Limit switches (not shown) are provided for limiting the traverse of the rack 28 by transmitting a signal effective for disengaging one clutch and engaging the other. Disengagement and engagement are effected by means of a pneumatic system which is shown in FIG. 1 beneath the clutches. This system will not be described in detail because it is of conventional nature.

It will be appreciated that in the aforedescribed apparatus the speed of rotation of the flier is proportional to the speed of reciprocation of the shaft 11. This is important in order that a uniform spacing is achieved between the turns of the coil being wound.

When very high speeds are required, the electric motor may be replaced by a turbine.

Figure 4:
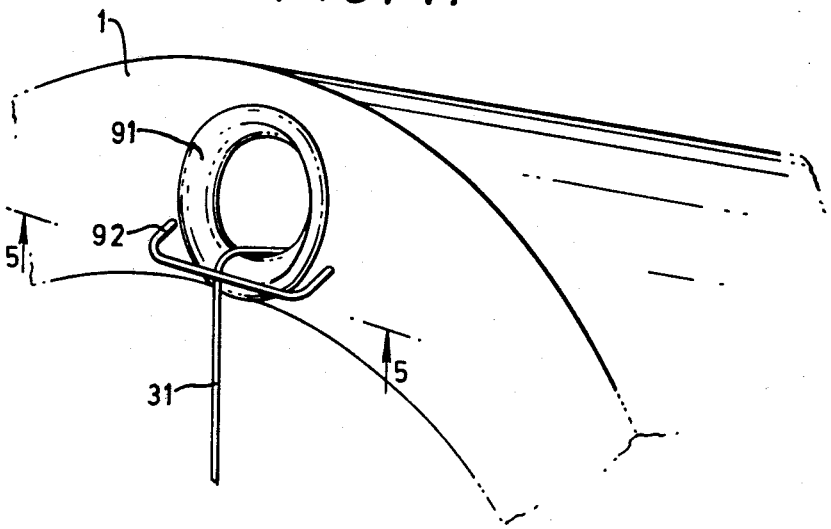
FIG. 4 is a scrap perspective view of one end of a modified fly winder.
Figure 5:
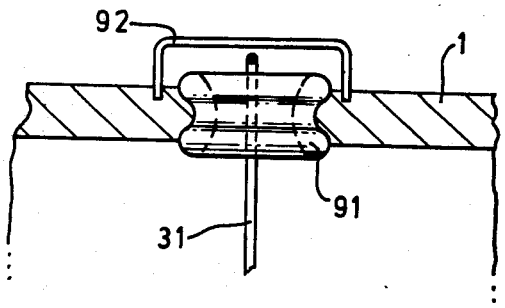
FIG. 5 is a cross-sectional view of the end of the fly winder shown in FIG. 4.

Referring to FIGS. 4 and 5, there is illustrated a modified flier particularly for winding flat coils and in which the guide member 9 comprises a ceramic eyelet 91 having belled-out entry and exit sections, and a keeper 92 mounted over the exit of the eyelet 91. The keeper 92 is formed of hardened steel wire and is bent to provide legs secured in the end of the flier 1. The keeper 92 acts to restrain pulsing of the wire 31 axially of the flier on winding flat bobbins and is spaced from the outlet surface of the eyelet 91 by a distance slightly greater than the wire diameter so that the wire is limited to a single plane during its radially inwards turning movement.

The wire keeper 91 may be replaced by equivalent means for restraining the wire axially at the exit from the guide, for example by a cover plate mounted on or integral with an eyelet similar to the eyelet 91.

The advantage of the fliers described above is that they reduce the drag on the wire which occurs whenever the wire changes direction. During such changes in direction the wire bears on the wire guide which inevitably results in drag or "bollard effect", the magnitude of which is determined by the magnitude of the change of direction and the coefficient of friction between the wire and the supporting surface. Thus the drag can be reduced by reducing the magnitude of the total angle through which the wire has to turn in its passage from a reel to the bobbin. Drag is also produced when the wire is fed through the conventional narrow orbital guide tube due to multiple contacts between the wire and the wall of the tube which occur when winding bobbins, such as flat bobbins, when the feed rate varies cyclically. The flier provided by the present invention minimise or avoid such problems and also provide a helical "reservoir" of wire which damps out variations in the wire feed rate.

Although the invention has been described both generally and particularly with reference to winding wire for an electrical coil, the invention can be used for winding other coils, and for winding threadlike elements other than wire.

What is claimed is:

1. For winding a filament about a bobbin or like former, a fly winder having a rotatable axially stationary hollow flier and a rotationally stationary bobbin support concentric with the hollow flier and axially reciprocable towards and away therefrom, wherein the hollow interior of the flier is a surface of rotation symmetrical about the axis of rotation of the flier forming a filament guide surface adapted to restrain outward radial movement of the filament, said surface of rotation increasing in diameter substantially smoothly along its length from an axially directed filament inlet guide closely circumscribing said axis at substantially the apex of said surface of rotation, the greater diameter end of the hollow interior being disposed adjacent to the bobbin support and being of diameter such that a bobbin or like former mounted on the support can be received therein, filament guide means being disposed at or adjacent to the greater diameter end and through which the filament is to be constrained to pass before being wound on the bobbin or like former with the filament having freedom of circumferential movement intermediate the filament inlet and the filament guide means.

2. A fly winder according to claim 1, wherein the hollow interior of the flier is substantially conical throughout its length and is arranged so that the filament enters the hollow interior substantially on the axis of rotation of the flier.

3. A fly winder according to claim 2, wherein the external surface of the flier is substantially conical in shape throughout its length and is symmetrical about said axis of rotation to facilitate high speed operation.

4. A fly winder according to claim 1, including a keeper bar positioned on the flier to restrain movement axially of the flier of the portion of the filament passing over the guide means.

5. A fly winder according to claim 1, comprising means for rotating the flier and means for reciprocating the bobbin support, the means having a common drive whereby the speed of rotation of the guide means is proportional to the speed of reciprocation of the support.

6. A fly winder according to claim 2 wherein the hollow interior has an axial length greater than the radius of said greater diameter end.

7. A fly winder according to claim 6, wherein the angle of said conical hollow interior is equal to or less than about 10°.

8. A fly winder according to claim 4, wherein the keeper bar comprises a wire guide adjacent the exit of said guide means.

9. A fly winder according to claim 1, wherein the guide means comprises an eyelet.

* * * * *